US005795373A

United States Patent [19]

Elmblad

[11] Patent Number: 5,795,373

[45] Date of Patent: Aug. 18, 1998

[54] FINISHING COMPOSITION FOR, AND METHOD OF MASS FINISHING

[75] Inventor: Kyle Elmblad, Kalamazoo, Mich.

[73] Assignee: Roto-Finish Co., Inc., Kalamazoo, Mich.

[21] Appl. No.: 871,474

[22] Filed: Jun. 9, 1997

[51] Int. Cl.[6] ..... C23F 11/00

[52] U.S. Cl. ..... 106/14.42; 106/14.13; 106/14.15; 106/14.18; 451/36; 451/37; 134/2; 134/4; 134/41

[58] Field of Search ..... 106/14.15, 14.13, 106/14.18, 14.42; 451/36, 37; 134/2, 4, 41

[56] References Cited

U.S. PATENT DOCUMENTS

| | | | |
|---|---|---|---|
| 4,313,837 | 2/1982 | Vukasovich et al. | 252/49.5 |
| 4,491,500 | 1/1985 | Michaud et al. | 216/87 |
| 4,705,594 | 11/1987 | Zobbi et al. | 216/90 |
| 4,736,547 | 4/1988 | Bond et al. | 451/330 |
| 4,818,333 | 4/1989 | Michaud et al. | 216/90 |
| 4,835,911 | 6/1989 | Bond et al. | 451/32 |
| 4,906,327 | 3/1990 | Michaud et al. | 216/90 |
| 5,047,095 | 9/1991 | Geke et al. | 148/259 |
| 5,158,623 | 10/1992 | Michaud et al. | 148/269 |
| 5,158,629 | 10/1992 | Zobbi | 216/53 |
| 5,284,593 | 2/1994 | Baevsky | 134/3 |
| 5,462,727 | 10/1995 | Engler | 106/14.15 |
| 5,571,408 | 11/1996 | Rising | 210/167 |
| 5,669,978 | 9/1997 | Brown | 134/1 |

OTHER PUBLICATIONS

Chemical Abstract No. 114:167623 which is an abstract of Polish Patent Specification No. 149256 Jan. 1990.

Chemical Abstract No. 125:62892 which is an abstract of Polish Patent Specification No. 168684 Mar. 1996.

*Primary Examiner*—Anthony Green

*Attorney, Agent, or Firm*—Flynn, Thiel, Boutell & Tanis, P.C.

[57] ABSTRACT

A composition and method of using the composition is provided which greatly aids in the removal of contaminants contained in a finishing solution used in a mass finishing process. The composition contains water, monoethanolamine borate, monoethanolamine octanoate and triethanolamine. The composition additionally contains either triethanolamine octanoate and an ethylene oxide-propylene oxide polymer or a linear alcohol ethoxylate and a cationic polyacrylamide.

10 Claims, No Drawings

FINISHING COMPOSITION FOR, AND METHOD OF MASS FINISHING

FIELD OF THE INVENTION

The present invention relates to a process for and a composition used in mass finishing where the surface of a workpiece is abraded through a combination of mechanical and chemical actions.

BACKGROUND OF THE INVENTION

The surface refinement of metallic and non-metallic workpieces is a necessary step in providing many of the goods commonly used in today's society. In mass finishing processes, metallic and non-metallic parts are added into a finishing apparatus along with a finishing composition and a finishing media and the surfaces of the parts are refined through the chemical action of the finishing composition and the mechanical action associated with the relative movement of the parts and the finishing media in the finishing apparatus. The finishing apparatus typically vibrates, rolls or has both types of motions and, through the combination of mechanical and chemical action, the desired surface treatment, which may be to brighten, deburr, reduce sharp edges, form a desired radius or refine the surface are accomplished.

Current process liquids which are used in today's mass finishing operations perform several functions. The most important function of these compositions is to clean the surface of the workpiece. In order to descale, deburr, burnish, form a coating on or inhibit the surface, the surface must first be cleaned. As such, compounds which emulsify the dirt, grease, oils and other contaminants typically found on the surface of a workpiece are usually provided in the finishing composition.

Conventional finishing compositions also usually contain a surfactant. The role of the surfactant in the finishing composition is to clean soils from the surface of the part, wet the surface of the part, help keep in solution the other components of the finishing composition and to aid in the surface refinement of the workpiece.

Conventional finishing compositions generate a large amount of foam and, as such, suspend and carry a great deal of abraded solids. These abraded solids result from the breakdown of the finishing media and the abrasion of the part. The solids range in size from a fraction of a micron to as much as 1–2 inches in length and width with a thickness of as much as 1/100th of an inch.

In the past, it was common practice in the industry to dispose of the finishing fluid after it became spent by way of a single pass through a finishing apparatus, which is known in the industry as "flow-through". However, economic considerations and environmental concerns help foster the current trend to reclaim the spent finishing solution and reuse it in the process. Current mechanisms of reclaiming the spent finishing solution are settling tanks, filtration systems, centrifuges, membrane separation systems and specialized chemical treatment systems. All of these mechanisms operate with conventional metal finishing compounds and are concerned with the removal of suspended solids. However, all of the current manners of reclaiming a spent finishing solution are either very slow, utilize an unduly large amount of space or are very expensive. As such, there is a need to provide a finishing composition which can be easily and inexpensively treated to remove the contaminants therein and then recycled to the finishing process for further use.

SUMMARY OF THE INVENTION

One of the aspects of the present invention is directed to providing a finishing composition which greatly facilitates the removal of suspended solids therefrom. The inventive composition contains monoethanolamine borate, monoethanolamine octanoate, triethanolamine and water. Additionally, either triethanolamine octanoate and an ethylene oxide-propylene oxide block polymer or a linear alcohol ethoxylate and a cationic polyacrylamide are provided in the inventive composition.

Another aspect of the present invention is directed to a process for finishing a workpiece wherein the workpiece is contained in a finishing solution and subjected to an abrasive action in a finishing apparatus and a contaminated finishing solution is formed. The contaminated finishing solution is removed from the finishing apparatus and treated to remove contaminants therefrom and the treated finishing solution is then recycled back to the finishing apparatus. In this aspect of the present invention, the finishing solution contains a composition comprising monoethanolamine borate, monoethanolamine octanoate, triethanolamine and water and additionally contains either of triethanolamine octanoate and an ethylene oxide-propylene oxide block polymer or a linear alcohol ethoxylate and a cationic polyacrylamide.

The composition and process of the present invention enables mass finishing operations to be performed in a more simplified and economic manner and the contaminants contained in the finishing solution to be more easily removed therefrom as compared to conventional finishing compositions and yet is environmentally compatible in that it does not have to be disposed of and can be recycled for further use in the finishing process.

DETAILED DESCRIPTION OF THE PREFERRED EMBODIMENT

It is believed that the present composition functions to enable contaminants to be more easily removed as follows.

Due to the minute nature of the suspended solids formed during the finishing process, the suspended solids are contained in the finishing solution as a colloidal suspension. The stability of this colloidal suspension is the result of slight static electrical charges on the particles which are generated by the rubbing action of the abrasive media on the surface of the workpiece which keeps the suspended solids from agglomerating and settling. The inventive composition neutralizes these static charges to facilitate the settling out of the suspended solids.

In one embodiment of the present invention, the composition is made up of monoethanolamine borate, monoethanolamine octanoate, triethanolamine octanoate, triethanolamine, an ethylene oxide-propylene oxide block polymer and the balance being water. Other additives, such as an antimicrobial compound, fragrances and dyes may be present as long as they do not interfere with the performance of the basic composition.

In another embodiment of the present invention, the inventive composition is made up of monoethanolamine borate, monoethanolamine octanoate, triethanolamine, a linear alcohol ethoxylate, a cationic polyacrylamide and the balance being water. This formulation can additionally contain other additives, such as a polymeric defoamer, an anti-microbial agent, fragrances and dyes as long as they do not interfere with the performance of the basic composition.

In the present invention, the amine borate and octanoate provide corrosion inhibition to the surface of the finished workpiece. The monoethanolamine borate is contained in the present composition in an amount of from 1–15% by weight, with 4–10% by weight being a preferred range and 6% by weight being the most preferred content amount. The monoethanolamine octanoate is contained in the inventive composition in an amount of from 1–10% by weight, with 2–6% by weight being a preferred range and 4% by weight being the most preferred content amount. The triethanolamine octanoate is contained in the inventive composition in an amount of from 1–20% by weight with 2–10% by weight being a preferred content range and 6% by weight being the most preferred content amount.

The triethanolamine is contained in the present composition in order to aid in the settling of the solids. It is believed that the free electrons of the triethanolamine neutralize the random static charges of the colloidal suspended solids, thereby increasing their tendency to agglomerate and fostering the settling of the particles. The triethanolamine is contained in the claimed composition in an amount of from 5–30% by weight, with 10–20% by weight being a preferred range and 15% by weight being the preferred content amount.

In a first embodiment of the inventive composition, a triethanolamine octanoate and an ethylene oxide-propylene oxide block polymer surfactant are present. As discussed above, the triethanolamine octanoate provides corrosion inhibition in the inventive composition. The triethanolamine octanoate is present in an amount of from 1–20% by weight, with 2–10% by weight being a preferred range and 6% by weight being the preferred content amount.

The ethylene oxide-propylene oxide block polymer surfactant aids in the lubrication and wetting of the workpiece surface. This surfactant has a natural affinity for suspended particles and fosters coagulation and agglomeration of the suspended solids which results in a larger particle with a higher density. This increases the tendency of the particle to settle and greatly aids any filtration or recirculation methods used to remove the particles.

A preferred molecular weight range of the ethylene oxide-propylene oxide block polymer is about 2,000–5,000, with about 3,000 being preferred. A suitable ethylene oxide-propylene oxide block polymer for use in the present invention is Chemax Inc.'s BP-3174®. The ethylene oxide-propylene oxide block polymer is preferably contained in the inventive formulation in an amount of from 5–15% by weight with 8–12% by weight being a more preferred range and 10% by weight being the most preferred content amount.

In this first embodiment of the present invention, water makes up the balance of the composition but, as discussed above, other additives may be present as long as they do not affect the basic properties of the inventive formulation.

In a second embodiment of the present invention, in addition to the water, monoethanolamine borate, monoethanolamine octanoate and triethanolamine, the inventive formulation contains a linear alcohol ethoxylate and a cationic polyacrylamide. The linear alcohol ethoxylate and cationic polyacrylamide serve the same purpose as the block polymer in the other formulation in that they provide lubrication and wetting of the workpiece surface and aid in the coagulation and the agglomeration of the suspended solids to increase the settling out of the suspended solids. Additionally, the linear alcohol ethoxylate helps keep the polyacrylamide in solution. A suitable polyacrylamide is Midfloc® 1338/1368 by Rochester Midland and a suitable linear alcohol ethoxylate is Triton® XL-80N by Union Carbide.

The linear alcohol ethoxylate is present in the inventive formulation in an amount of from 0.5–5% by weight, with 1–3% by weight being preferred and 1% by weight being the most preferred content amount. The cationic polyacrylamide is present in an amount of from 0.001–4% by weight with 0.01–0.1% by weight being a preferred range and 0.02% by weight being the most preferred content amount.

A polymeric defoamer can also be present in the second embodiment of the present invention in order to control the foam resulting from the use of the linear alcohol ethoxylate and the cationic polyacrylamide. The amount of defoamer needed is readily determined by one of ordinary skill in the art but, in general, an amount of from 0.01–1% by weight is suitable. As with the previously discussed formulation, additional additives, such as antimicrobial compounds, etc., can be present as long as they do not affect the properties of the basic formulation. A particularly desirable anti-microbial composition for use in the present invention is Biopan® P-1487 by Angus Chemicals.

The formulations of the present invention function not only as effective settling fluids but also serve as highly effective finishing and deburring compositions. Moreover, the compositions of the present invention also disperse many types of industrial oils as opposed to the conventional emulsification of the oils that occur in prior art formulations. The dispersability properties of the present formulations allow the oil to separate from the fluid whereby it can be removed from the system by skimmers, overflow baffles and other separation apparatuses. Unexpectedly, the inventive formulations also have superior corrosion protection properties and although, in most situations, a post-dipping in a corrosion inhibiting solution is required to protect the part, the present formulations provide adequate protection for most normal manufacturing purposes.

In applications using steel finishing media, acid-based compositions are used to maintain the brightness and cleanliness of the media and parts. The present invention provides comparable results without the use of acids in this type of service. Additionally, the low foamability of the present formulations along with their lubricating properties tends to reduce the overall processing time necessary to finish the part and reclaim the finishing solution as compared to conventional compounds. The compositions of the present invention are particularly suitable for treatment and settling apparatuses in which the direction of flow of the solution to be reclaimed is changed several times in order to aid in the settling out of the suspended solids. Such an apparatus is illustrated in U.S. Pat. No. 5,571,408, to Rising, and the disclosure of this patent is hereby incorporated by reference into the present application.

Although preferred embodiments of the present invention have been discussed for illustrative purposes, the present invention is not limited thereby and it would be possible for one of ordinary skill in the art to substitute equivalents and not depart from the spirit and scope of the present invention.

I claim:

1. A composition used in a mass finishing process comprising 1–15 wt. % monoethanolamine borate, 1–10 wt. % monoethanolamine octanoate, 5–30 wt. % triethanolamine and water.

2. The composition of claim 1, additionally comprising 1–20 wt. % triethanolamine octanoate and 5–15 wt. % of an ethylene oxide-propylene oxide block polymer.

3. The composition of claim 2, additionally comprising 0.01–1 wt. % of an antimicrobial compound.

4. The composition of claim 1, additionally comprising 0.5–5 wt. % of a linear alcohol ethoxylate and 0.001–4 wt. % of a cationic polyacrylamide.

5. The composition of claim 4, additionally comprising 0.01–1 wt. % of a defoaming compound and 0.01–1 wt. % of an antimicrobial compound.

6. In a process of mass finishing a workpiece wherein the workpiece is subjected to an abrasive action in a finishing solution contained in a finishing apparatus, a contaminated finishing solution is formed in said finishing apparatus, the contaminated finishing solution is removed from the finishing apparatus and treated to remove contaminants therefrom and the treated finishing solution is recycled back to the finishing apparatus, the improvement comprising said finishing solution containing a composition comprising 1–15 wt. % monoethanolamine borate, 1–10 wt. % monoethanolamine octanoate, 5–30 wt. % triethanolamine and water.

7. The process of claim 6, wherein the composition additionally comprises 1–20 wt. % triethanolamine octanoate and 5–15 wt. % of an ethylene oxide-propylene oxide block polymer.

8. The process of claim 7, wherein the composition additionally comprises 0.01–1 wt. % of an antimicrobial compound.

9. The process of claim 6, wherein the composition additionally comprises 0.5–5 wt. % of a linear alcohol ethoxylate and 0.001–4 wt. % of a cationic polyacrylamide.

10. The process of claim 9, wherein the composition additionally comprises 0.01–1 wt. % of a defoaming compound and 0.01 to 1 wt. % of an antimicrobial compound.

* * * * *